US005746686A

United States Patent [19]

Berman et al.

[11] Patent Number: 5,746,686

[45] Date of Patent: May 5, 1998

[54] EXERCISE APPARATUS

[76] Inventors: Paul Berman, 1650 Tenth St., Santa Monica, Calif. 90404; Jim Kraushaar, 9 Pemberton Pl., Laguna Niguel, Calif. 92677

[21] Appl. No.: 787,629

[22] Filed: Jan. 23, 1997

[51] Int. Cl.[6] ..... A63B 21/02

[52] U.S. Cl. ..... 482/125; 482/126; 482/122

[58] Field of Search ..... 482/121, 122, 482/124, 125, 126

[56] References Cited

U.S. PATENT DOCUMENTS

| | | | |
|---|---|---|---|
| 4,517,966 | 5/1985 | Von Othegraven | 482/125 |
| 5,232,425 | 8/1993 | Miller et al. | 482/125 |
| 5,397,288 | 3/1995 | Sayre | 482/125 |
| 5,489,251 | 2/1996 | Robles, Jr. | 482/124 |

*Primary Examiner*—Lynne A. Reichard

*Attorney, Agent, or Firm*—Gene Scott-Patent Law & Venture Group

[57] ABSTRACT

An exercise apparatus (10) consists of an elongated frame (12) tubular, in construction, having an upper end and a lower end. The frame (12) comprises a frame left slot (12L) and a frame right slot (12R), the frame left slot (12L) and frame right slot (12R) comprises an opening therebetween. A preload housing (16) securely attached to an upper distal end of the frame (12) therearound. The preload housing (16) comprises a preload housing adjuster (16A) removably fastened to a preload housing adjuster handle (16AA) by a removable fastening means. The preload housing adjuster handle (16AA) functions as a grip for the user, the preload housing (16) further comprises a preload housing slide (16B) slidably attached to the frame (12) at a mid distal point. An adjuster (26) functions to vary the resistance load. A lower slide (18) is movably attached to the frame (12). The lower slide (18) functions to support the user's left foot. A resistance device functions to provide a resistance to an user.

14 Claims, 3 Drawing Sheets

EXERCISE APPARATUS

BACKGROUND OF THE INVENTION

1. Field of the Invention

The present invention relates to personal health. More particularly, the present invention relates to exercise equipment particularly for exercising the legs.

2. Description of the Prior Art

Leg exercise apparatus in the prior art generally fall into two general types of equipment. Cardio-vascular machines which use a rotational apparatus such as a bicycle crank or alternating peddles attached to a resistance means function to elevate the heart beat of the user which when maintained for a prescribed period of time on a regular based strengthens the heart muscles and lowers the risk of heart attacks. The range of movement in these devices is limited to the range of the crank arm or peddle movement. Toning and strengthening is achieved over a limited range but is a secondary purpose of the device.

The second type of device functions to tone and shape the legs of an user by causing the leg muscles to build up. In these devices leg movement ranges from fully extended to contracted. Because of this flexibility an exercise program can be tailored to accentuate a specific portion of the leg and thus shape a desirable areas. Since this type device must move the leg over a wide range the device itself typically requires considerable geography. The prior art discloses devices of this type built in to multipurpose exercise machines not as a standalone device.

The present invention provides a full range of leg extension and retraction in a space slightly larger than the extended leg. Further the present invention collapses so it can be stored in a minimal floor space.

Numerous innovations for Exercise Device have been provided in the prior art that are described as follows. Even though these innovations may be suitable for the specific individual purposes to which they address, they differ from the present invention as hereinafter contrasted.

In Patent No. 4,463,947, titled Knee and Leg Orthopedic Exercising Device, invented by Arthur F. Kloenne, a knee and leg orthopedic exercising device is shown for use by a person that is seated in a chair. The device itself is a wide leg rest that may accommodate both legs of the user, although it could be used for one leg at a time. This leg rest has a side profile of an inverted capital T having a vertical shank portion that is supported from a generally perpendicular crown portion. The edge of one end of the crown portion is provided with an elongated roller which is adapted to roll upon a floor surface. The top side of the side of the crown portion which is remote from the roller serves as a footrest, while the side of the shank portion of the leg rest which is remote from the roller serves to support the shank of at least one of the legs of the user. This leg rest is provided with holding straps for holding the shank portion of the leg rest against the underside of the shank portion of the user's leg as the user flexes the leg between a vertical and an inclined, outstretched position. Two modifications of these holding straps are shown. One modification includes a pair of hand straps to be engaged by the user's hands for exerting a pulling force and ensuring that the crown portion of the leg rest remains against the foot or fee to the user. A second modification of holding straps is the use of a pair of leg straps which are wound around the user's legs and around the shank portion of the leg rest to bind the leg to the leg rest so that they move in unison.

In Patent No. 4,492,375, titled Resilient Type Exercising Device with Removable Weights, invented by Richard E. Connelly, a physical exercise apparatus is disclosed that has a column, a sleeve slidably engaging and lockable at selected positions along the column, a lever pivotally connected to the sleeve and a removable bench connected to the column. Endless elastic bands or torsional springs may be attached to the lever and to the sleeve to provide variable resistance to pivoting of the lever or the lever may be connected to the sleeve so as to restrict pivoting of the lever.

In Patent No. 4,946,162, titled Portable Exercise Apparatus, invented by Nathan F. Luble, a compact and portable exercise apparatus is disclosed. A frame assembly having a wedge type of shape comprising aluminum structural members has mounted thereto a pair of hydraulic cylinders which are interconnected by a hydraulic flow line containing an adjustable needle valve. The other end of the hydraulic cylinders is connected to a foot pedal which allows the force of a person's downward push of his legs to act upon the resistance provided within the hydraulic circuitry and which automatically causes the opposite foot pedal travel upward. The exercise apparatus is intended to primarily be used in conjunction with a person sitting in an ordinary chair.

In Patent No. D348,492, titled Leg Exerciser, invented by James Konarski, the ornamental design for a leg exerciser is as shown and described.

In Patent No. 4,805,901, titled Collapsible Exercise Device, invented by John M. Kulick, an ottoman-like furniture piece serves as a storage unit for an integrated collapsible exercising mechanism. The housing of the unit can be converted to form a chair on which the subject may sit during exercise, and the unique construction of the mechanism enables it to be readily folded into a compact configuration for storage.

In Patent No. D321,390, titled Leg Press Physical Exerciser, invented by Gary A. Jones, the ornamental design for a leg press physical exerciser, is as shown and described.

In Patent No. 4,262,902, titled Portable Exercise Device, invented by Marvin A. Dransclka, a portable pedaling type exercise device which is attachable to a conventional chair without alteration includes a rear member which is held rigidly between a pair of opposing legs of a chair by the application of compressive force.

Flexibility in the location of the pedal assembly in relation to the chair and floor is achieved through adjustable length members of the supporting frame. A direct mechanism for applying selective drag to the pedal shaft and removable stirrups for securing feet to the pedals are also provided.

Numerous innovations for Exercise Device have been provided in the prior art that are adapted to be used. Even though these innovations may be suitable for the specific individual purposes to which they address, they would not be suitable for the purposes of the present invention as heretofore described.

SUMMARY OF THE INVENTION

Exercising of the legs is an important part of a full health program. Numerous devices exist in combination or separately to exercise the legs. Most of these exercise devices have significant drawbacks such as exercising the legs over a limited range of movement, difficulty in storage, independent of the user support such as a chair. Limiting the range of movement decreases the overall effectiveness of the total exercise effort. Several devices would be difficult to keep in proximity to an user support such as a chair requiring readjustment periodically. Other prior art is attached to a main framework of exercise gear and cannot be removed with out a major disassembly effort. Finally some are difficult to store and time consuming to set up for use.

In the prior art, unsuccessful attempts to solve this problem were attempted namely devices which resemble foot peddles combined with a resistance means and devices attached to a larger apparatus. However, the patented inventions either limit the leg movement to a narrow range, are bulky when not in use, or require the user to attain an awkward position Innovations within the prior art are rapidly being exploited as witnesses by the explosion of fitness related equipment in stores and as the subject of infomercials The present invention solved a long felt need for a simple leg exercise and shaping device that can be easily used and stored, consuming a small floor area.

Accordingly, it is an object of the present invention to provide a resistance to leg muscles over a full range of movement functioning to aid leg shaping, toning, and strengthening.

More particularly, it is an object of the present invention to provide an adjustable resistance.

In keeping with these objects, and with others which will become apparent hereinafter, one feature of the present invention resides, briefly stated, in resistance means consisting of hydraulic, pneumatic, and elastic.

In accordance with another feature of the present invention, the handle is removable.

Another feature of the present invention is that a brace is provided which removably attaches the exercise apparatus to a chair.

Yet another feature of the present invention is that the leg brace, stabilizer and brace are removable for storage.

Still another feature of the present invention is that in the operative position minimum floor space is required.

Yet still another feature of the present invention is that the resistance means is hydraulic, pneumatic or elastic which provides for a choice of resistance.

Still yet another feature of the present invention is that hydraulic and pneumatic resistance means provide for bidirectional resistance.

Another feature of the present invention is that an adjuster permits the strength of resistance to be regulated.

Yet another feature of the present invention is that a lower slide having a leg brace are slidable attached to a frame.

Still another feature of the present invention is that a handle is provided functioning to stabilize the device when grasped by an user.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10-exercise apparatus (10)

12-frame (12)

12L-frame left slot (12L)

12R-frame right slot (12R)

14-brace (14)

14A-brace horizontal member (14A)

14B-brace angled member (14B)

16-preload housing (16)

16A-preload housing adjuster (16A)

16AA-preload housing adjuster handle (16AA)

16B-preload housing slide (16B)

16BA-preload housing barrel (16BA)

16BL-preload housing left post (16BL)

16BR-preload housing right post (16BR)

18-lower slide (18)

18L-lower slide left post (18L)

18R-lower slide right post (18R)

20-leg brace (20)

20L-leg brace left member (20L)

20R-leg brace right member (20R)

22-stabilizer (22)

22L-stabilizer left member (22L)

22R-stabilizer right member (22R)

24-resistance device (24)

24L-left resistance device (24L)

24R-right resistance device (24R)

26-adjuster (26)

26A-adjuster knob (26A)

26B-adjuster rod (26B)

26BA-adjuster rod threaded portion (26BA)

26C-adjuster retention device (26C)

26D-adjuster thrust bearing (26D)

BRIEF DESCRIPTION OF THE PREFERRED EMBODIMENT

DETAILED DESCRIPTION OF THE PREFERRED EMBODIMENT

Figure 1:
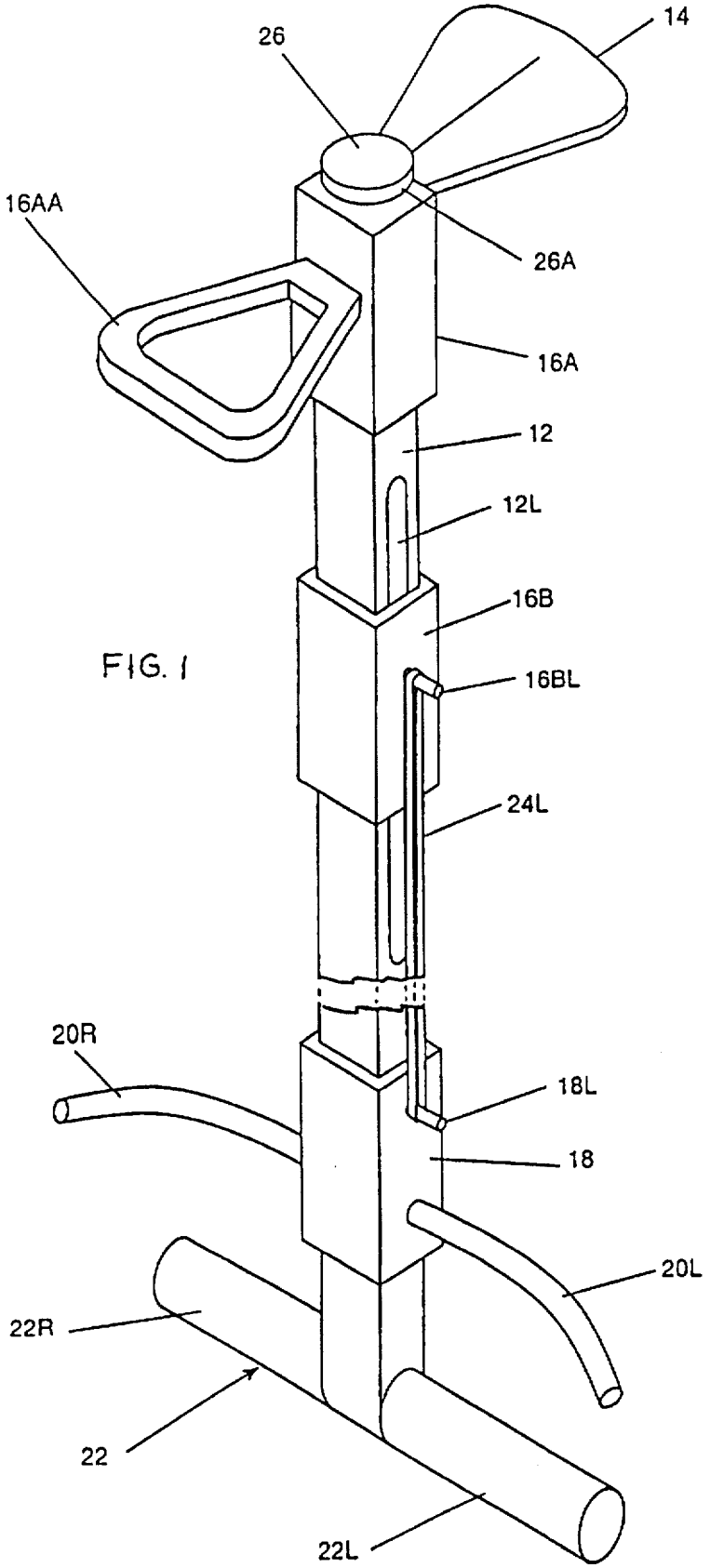
FIG. 1 is a perspective of an exercise device.

Firstly, referring to FIG. 1 which is a perspective of an exercise device (10) comprising a frame (12). The frame (12) is elongated and tubular in construction. The frame (12) comprises a frame left slot (12L) and a frame right slot (12R) at mid distal points. The frame left slot (12L) and frame right slot (12R) comprises an opening therebetween.

A preload housing (16) securely attached to an upper distal end of the frame (12) therearound. The preload housing (16) comprises a preload housing adjuster (16A) removably fastened to a preload housing adjuster handle (16AA) by a removable fastening means. The preload housing adjuster handle (16AA) functions as a grip for the user. The preload housing (16) further comprises a preload housing slide (16B) slidably attached to the frame (12) at a mid distal point.

An adjuster (26) comprises an adjuster knob (26A) which is rotationally attached to the preload housing adjuster (16A). The adjuster (26) functions to change the distance between the preload housing adjuster (16A) and the preload housing slide (16B).

A lower slide (18) is movably attached to the frame (12). The lower slide (18) comprises a lower slide left post (18L)

which is securely attached at a left distal side. The lower slide (18) further comprises a lower slide right post (18R) which is securely attached to a right distal side of the lower slide (18). A leg brace left member (20L) is securely attached to a left distal side of the lower slide (18). The leg brace left member (20L) functions to support the user's left foot. A leg brace right member (20R) is securely attached to a right distal side of the lower slide (18). The leg brace right member (20R) functions to support the user's right foot.

A left resistance device (24L) securely attached at one distal end to the preload housing left post (16BL) and at the opposite distal end to the foot peg left post (18L). The left resistance device (24L) functions to provide a resistance to an user. The left resistance device (24L) is selected from a group consisting of elastics, springs, hydraulic cylinders, and pneumatic cylinders.

A right resistance device (24R) securely attached at one distal end to the foot peg right post (18R) on one distal end and to the preload housing right post (16BR) on the opposite distal end. The right resistance device (24R) functions to provide a resistance to an user. The right resistance device (24R) is selected from a group consisting of elastics, springs, hydraulic cylinders, and pneumatic cylinders.

The frame (12) further comprises a stabilizer (22) which is securely attached at a lower distal end. The stabilizer (22) comprises a stabilizer left member (22L) securely attached thereto projecting perpendicular to the stabilizer (22) on a left side. The stabilizer (22) further comprises a stabilizer right member (22R) which attached thereto and projects perpendicular to the stabilizer (22) on a right side.

A resistance device (24) comprises a left resistance device (24L). The left resistance device (24L) is securely attached to the preload housing left post (16BL) on the upper distal end. The left resistance device (24L) is securely attached at a lower distal end to a lower slide left post (18L). The resistance device (24) functions to provide a resistance to user.

A brace (14) comprises a brace horizontal member (14A) which is securely attached at one distal edge to a brace angled member (14B). The brace angled member (14B) is removably attached to the upper distal end of the elongated frame (12) by a fastening means. The brace (14) functions to secure an upper distal end of the exercise apparatus (10) to a seat.

The exercise apparatus (10) is manufactured from a material selected from a group consisting of metal, metal alloy, plastic, plastic composite, wood, fiberglass, glass, ceramic, and stone.

Figure 2:
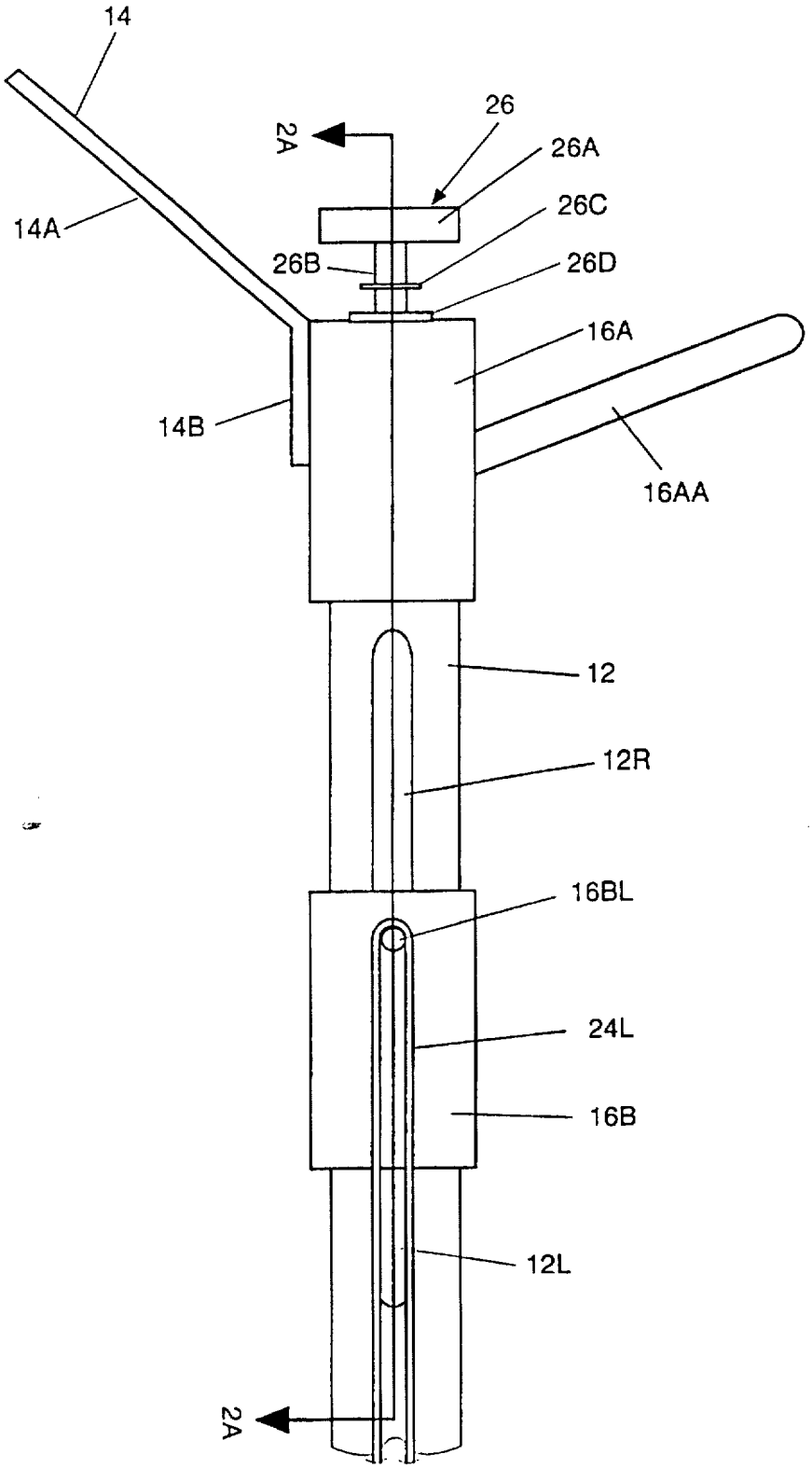
FIG. 2 is a left side view of a preload housing.

Secondly, referring to FIG. 2 which is a left side view of the preload housing (16) securely attached to an upper distal end of the frame (12) therearound. The preload housing (16) comprises a preload housing adjuster (16A) removably fastened to a preload housing adjuster handle (16AA) by a removable fastening means. The preload housing adjuster handle (16AA) functions as a grip for the user. The preload housing (16) further comprises a preload housing slide (16B) slidably attached to the frame (12) at a mid distal point. The preload housing slide (16B) comprises a preload housing barrel (16BA). The preload housing barrel (16BA) is securely attached at a left distal side to a middle distal point of a preload housing left post (16BL). The preload housing left post (16BL) protrudes through a left distal end of the preload housing barrel (16BA). The preload housing barrel (16BA) is securely attached at a right distal end to a middle distal point of a preload housing right post (16BR). The preload housing right post (16BR) protrudes through a right distal end of the preload housing slide (16B).

An adjuster (26) comprises an adjuster knob (26A) which is rotationally attached to the preload housing adjuster (16A). The adjuster (26) functions to change the distance between the preload housing adjuster (16A) and the preload housing slide (16B).

A left resistance device (24L) securely attached at one distal end to the preload housing left post (16BL) functions to provide a resistance to an user. The left resistance device (24L) is selected from a group consisting of elastics, springs, hydraulic cylinders, and pneumatic cylinders.

A brace (14) comprises a brace horizontal member (14A) which is securely attached at one distal edge to a brace angled member (14B). The brace angled member (14B) is removably attached to the upper distal end of the elongated frame (12) by a fastening means. The brace (14) functions to secure an upper distal end of the exercise apparatus (10) to a seat.

Figure 2A:
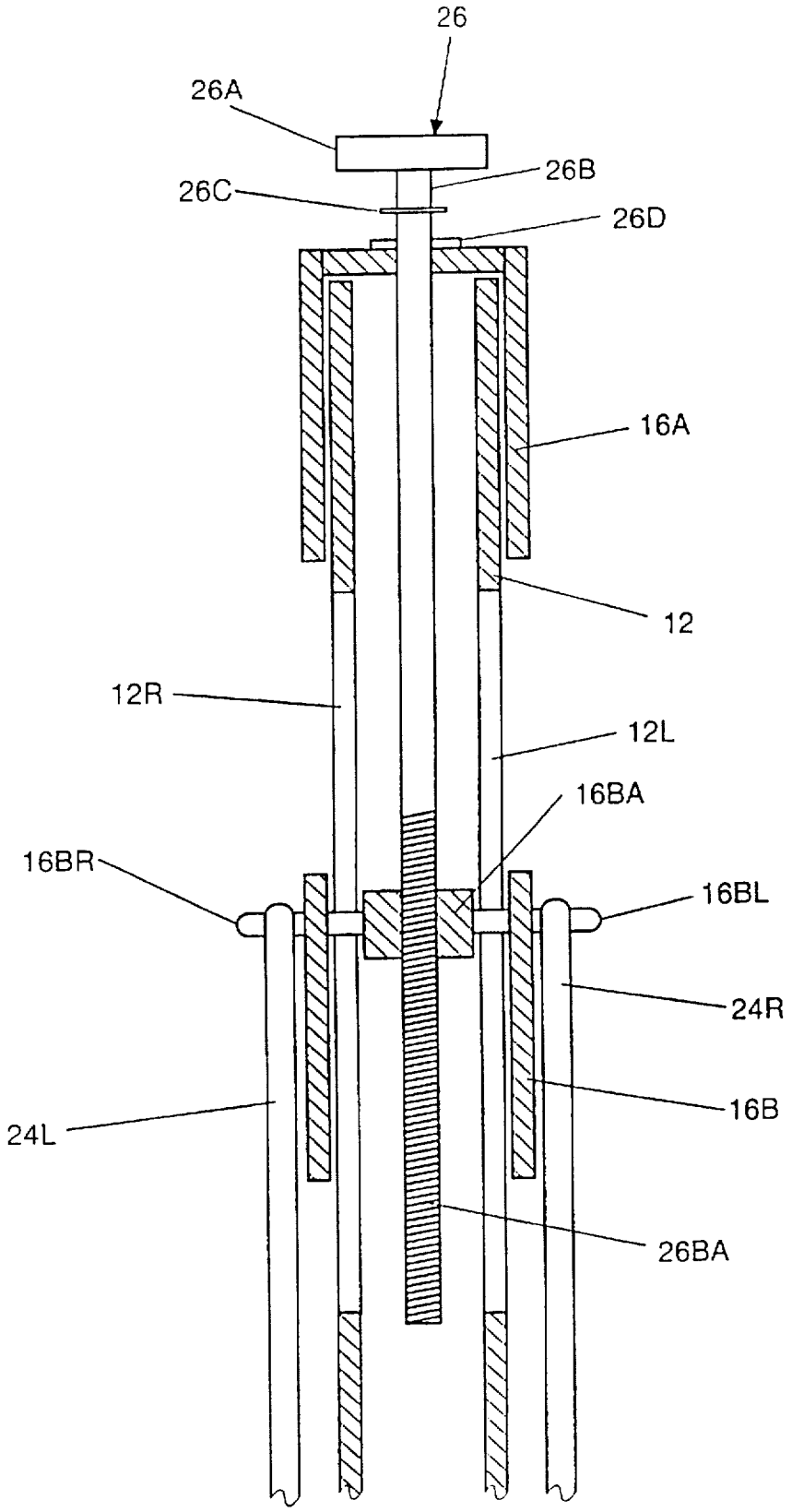
FIG. 2A is a cross-sectional view of a preload housing.

Finally, referring to FIG. 2A which is a cross-sectional view of a preload housing (16) at line 2A. The is securely attached to a frame (12). The frame (12) is elongated and tubular in construction. The frame (12) comprises a frame left slot (12L) and a frame right slot (12R) at mid distal points. The frame left slot (12L) and frame right slot (12R) comprises an opening therebetween.

The preload housing (16) is securely attached to an upper distal end of the frame (12) therearound. The preload housing (16) comprises a preload housing slide (16B) slidably attached to the frame (12) at a mid distal point. The preload housing slide (16B) comprises a preload housing barrel (16BA). The preload housing barrel (16BA) is securely attached at a left distal side to a middle distal point of a preload housing left post (16BL). The preload housing left post (16BL) protrudes through a left distal end of the preload housing barrel (16BA). The preload housing barrel (16BA) is securely attached at a right distal end to a middle distal point of a preload housing right post (16BR). The preload housing right post (16BR) protrudes through a right distal end of the preload housing slide (16B).

The adjuster (26) comprises an adjuster knob (26A) centrally attached to one distal end of an adjuster rod (26B). An adjuster rod threaded portion (26BA) is securely attached to an opposite distal end of the adjuster rod (26B). The adjuster rod threaded portion (26BA) rotationally cooperates with the preload housing barrel (16BA) to provide an adjustment when the adjuster knob (26A) is rotated, the adjuster (26) further comprises an adjuster retention device (26C) rotationally attached to the adjuster rod (26B) at an upper distal end, the adjuster retention device (26C) functions to prevent the adjuster rod (26B) from sliding through the preload housing adjuster (16A), the adjuster (26) still further comprises an adjuster thrust bearing (26D) functioning to prevent wear of the preload housing adjuster (16A) when the adjuster rod (26B) is rotated by an user.

A left resistance device (24L) securely attached at one distal end to the preload housing left post (16BL) and at the opposite distal end to the foot peg left post (18L).

The left resistance device (24L) functions to provide a resistance to an user. The left resistance device (24L) is selected from a group consisting of elastics, springs, hydraulic cylinders, and pneumatic cylinders.

A right resistance device (24R) securely attached at one distal end to the foot peg right post (18R) on one distal end and to the preload housing right post (16BR) on the opposite distal end. The right resistance device (24R) functions to provide a resistance to an user. The right resistance device (24R) is selected from a group consisting of elastics, springs, hydraulic cylinders, and pneumatic cylinders.

The exercise apparatus (10) is manufactured from a material selected from a group consisting of metal, metal alloy, plastic, plastic composite, wood, fiberglass, glass, ceramic, and stone.

It will be understood that each of the elements described above, or two or more together, may also find an useful application in other types of constructions differing from the type described above.

While the invention has been illustrated and described as embodied in an exercise Device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. An exercise apparatus comprising:

a tubular elongated frame having an upper end and a lower end;

a preload housing securely attached to said upper end of said tubular elongated frame;

a brace securely attached to said preload housing, said brace extending outwardly from said preload housing, said brace comprising a brace horizontal member and a brace angle member, said brace horizontal member securely attached at one end to said preload housing and at the other end to said brace angle member, wherein the brace is adapted to allow securement of the upper end of the exercise apparatus to a seat when a user sits thereon;

a lower slide movable attached to said frame;

a leg brace left member securely attached to the left side of said lower slide, wherein said leg brace left member is adapted to support the user's left foot;

a leg brace right member securely attache d to the right side of said lower slide, wherein said leg brace right member is adapted to support the user's left foot; and a resistance device securely attached at one end to said preload housing and at the other opposite end to the lower slide.

2. The exercise apparatus of claim 1, wherein said resistance device comprises a left resistance device securely attached at one end to the preload housing and at the other opposite end to said lower slide and a right resistance device securely attached at one end to the preload housing and at the other opposite end to said lower slide.

3. The exercise apparatus of claim 1, wherein said frame comprises a frame left slot and a frame right slot which together form an opening through said frame.

4. The exercise apparatus of claim 1, wherein the preload housing comprises a preload housing adjuster removably fastened to a preload housing adjuster handle by a removable fastening means, wherein said preload housing adjuster handle is adapted to provide a grip for the user; said preload housing further comprising a preload housing slide slidably attached to said frame; wherein said preload housing slide comprises a preload housing barrel securely attached at the left side to a preload housing left post and at the right side to a preload housing right post.

5. The exercise apparatus of claim 4, wherein said preload housing adjuster comprises an adjuster knob attached to one end of an adjuster rod, said adjuster rod having a threaded portion at the opposite end thereof which is rotatably attached to said preload housing barrel to provide adjustment when said adjuster knob is rotated.

6. The exercise apparatus of claim 5, wherein said preload housing adjuster further comprises an adjuster retention device rotatably attached to said adjuster rod at the upper end thereof to prevent said adjuster rod from becoming disengaged from said preload housing.

7. The exercise apparatus of claim 6, wherein said preload housing adjuster further comprises an adjuster thrust bearing to prevent wear of said preload housing when said adjuster rod is rotated by a user.

8. The exercise apparatus of claim 1, wherein said lower slide comprises a lower slide left post securely attached to the left side of said lower slide and a lower slide right post securely attached to the right said of said lower slide.

9. The exercise apparatus of claim 2, wherein said lower slide comprises a lower slide left post securely attached to the left side of said lower slide and a lower slide right post securely attached to the right said of said lower slide.

10. The exercise apparatus of claim 9, wherein said left resistance device is securely attached at one end to a preload housing left post and at the other opposite end to said lower slide left post.

11. The exercise apparatus of claim 10, wherein said left resistance device is selected from a group consisting of: elastic, springs, hydraulic cylinders and pneumatic cylinders.

12. The exercise apparatus of claim 2, wherein said right resistance device is selected from a group consisting of: elastic, springs, hydraulic cylinders, and pneumatic cylinders.

13. The exercise apparatus of claim 1, wherein said frame is securely attached at a lower end to a stabilizer, said stabilizer comprising a left stabilizer on the left side of said frame and a right stabilizer on the right side of said frame to prevent the exercise apparatus from rotating while in use.

14. The exercise apparatus of claim 1, wherein the exercise apparatus is manufactured from a material selected from a group consisting of: metal, metal alloy, plastic, plastic compounds, wood, fiberglass, glass, ceramic, and stone.

* * * * *